US008657184B2

(12) United States Patent
Gao

(10) Patent No.: US 8,657,184 B2
(45) Date of Patent: Feb. 25, 2014

(54) FOLDABLE PAPER BOX

(75) Inventor: Luisa Gao, Taipei (TW)

(73) Assignee: Unimasa Co., Ltd., Kaohsiung (TW)

( * ) Notice: Subject to any disclaimer, the term of this patent is extended or adjusted under 35 U.S.C. 154(b) by 272 days.

(21) Appl. No.: 13/169,580

(22) Filed: Jun. 27, 2011

(65) Prior Publication Data

US 2011/0315754 A1 Dec. 29, 2011

(30) Foreign Application Priority Data

Jun. 28, 2010 (CN) ..... 2010 2 0239188 U

(51) Int. Cl.
*B65D 5/24* (2006.01)
*B65D 5/32* (2006.01)

(52) U.S. Cl.
USPC ..... 229/122.34; 229/122.32; 229/167; 229/171; 229/180

(58) Field of Classification Search
USPC ..... 229/122.32, 122.34, 125.08, 167, 168, 229/171, 173, 180
See application file for complete search history.

(56) References Cited

U.S. PATENT DOCUMENTS 690,575 A * 1/1902 Herre ..... 229/173
2,495,807 A * 1/1950 Buttery ..... 229/171
3,728,002 A * 4/1973 Zacks ..... 229/125.08
3,837,561 A * 9/1974 Rubin ..... 229/125.08
4,258,881 A * 3/1981 Mode et al. ..... 229/171
4,341,339 A * 7/1982 Zore ..... 229/167
4,380,314 A * 4/1983 Langston et al. ..... 229/122.32
4,477,015 A * 10/1984 Lozaun ..... 229/122.34
5,078,268 A * 1/1992 Olson et al. ..... 229/122.34
5,353,984 A * 10/1994 Liu et al. ..... 229/168
6,843,408 B1 * 1/2005 Agren ..... 229/167
7,481,355 B2 1/2009 Hui
2005/0092821 A1 * 5/2005 Mazurek ..... 229/122.34
2006/0163334 A1 * 7/2006 Kay ..... 229/122.32
2010/0294831 A1 * 11/2010 Hallam ..... 229/122.32
2010/0314436 A1 * 12/2010 Tao ..... 229/122.32

FOREIGN PATENT DOCUMENTS

JP 64-45247 A * 2/1989 ..... 229/167

* cited by examiner

*Primary Examiner* — Gary Elkins
(74) *Attorney, Agent, or Firm* — Hamre, Schumann, Mueller & Larson, P.C.

(57) ABSTRACT

A foldable paper box includes an inner panel that has an inner base wall secured to an outer base wall of an outer panel, two first inner sidewalls and two second inner sidewalls connected foldably to the inner base wall to confine a receiving space that is closed by a cover wall of the outer panel. The outer and inner base walls confine therebetween two insert slots adjacent to the first inner sidewalls. The first inner sidewalls are insertable partially into respective insert slots after being folded to extend uprightly from the inner base wall. The second inner sidewalls are inserted partially and non-removably in between the inner and outer base walls and secured to the outer base wall after being folded.

8 Claims, 8 Drawing Sheets

FOLDABLE PAPER BOX

CROSS-REFERENCE TO RELATED APPLICATION

This application claims priority of Chinese Patent Application No. 201020239188.2 filed on Jun. 28, 2010.

BACKGROUND OF THE INVENTION

1. Field of the Invention

The invention relates to a foldable paper box, and more particularly to a foldable paper box that includes a foldable inner panel secured to a foldable outer panel.

2. Description of the Related Art

Conventional foldable paper boxes are made from foldable flat paperboard blanks that save space and can be transported conveniently when they are delivered from factories. The flat paperboard blanks can be formed into three dimensional box structures when folded. An example of such conventional folded boxes is disclosed in U.S. Pat. No. 7,481,355. However, when the paperboard blank disclosed in the US patent is folded into a three dimensional box structure, holding means such as adhesive, magnet, or Velcro fasteners must be used in order to hold the paperboard blank in a folded three dimensional configuration.

SUMMARY OF THE INVENTION

An object of the present invention is to provide a paper box that can be unfolded to a flat configuration and that can be placed in a three dimensional folded configuration without using external fasteners.

According to the present invention, a foldable paper box comprises an outer panel and an inner panel. The outer panel includes a longitudinal outer panel that has parallel first and second fold lines extending transversely of a longitudinal direction of the outer panel and dividing the outer panel into an outer base wall, a cover wall, and a first outer sidewall between the outer base wall and the cover wall. The outer panel is foldable along the first and second fold lines to place the cover wall above the outer base wall.

The inner panel has an inner base wall secured to the outer base wall, two opposite parallel first inner sidewalls connected foldably and respectively to two opposite first sides of the inner base wall, two opposite parallel second inner sidewalls connected foldably and respectively to two opposite second sides of the inner base wall, which are connected between the first sides of the inner base wall, the first and second inner sidewalls confining a receiving space on the inner base wall when folded to extend uprightly from the inner base wall. The receiving space is covered by the cover wall when the outer panel is folded over the inner base wall. The outer and inner base walls confine therebetween two insert slots respectively adjacent to the first inner sidewalls. The first inner sidewalls are foldable upwardly and outwardly from the inner base wall and insertable partially, removably and respectively into the insert slots. The second inner sidewalls are folded outwardly from the inner base wall, inserted partially between the inner and outer base walls, and secured non-removably to the outer base wall.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
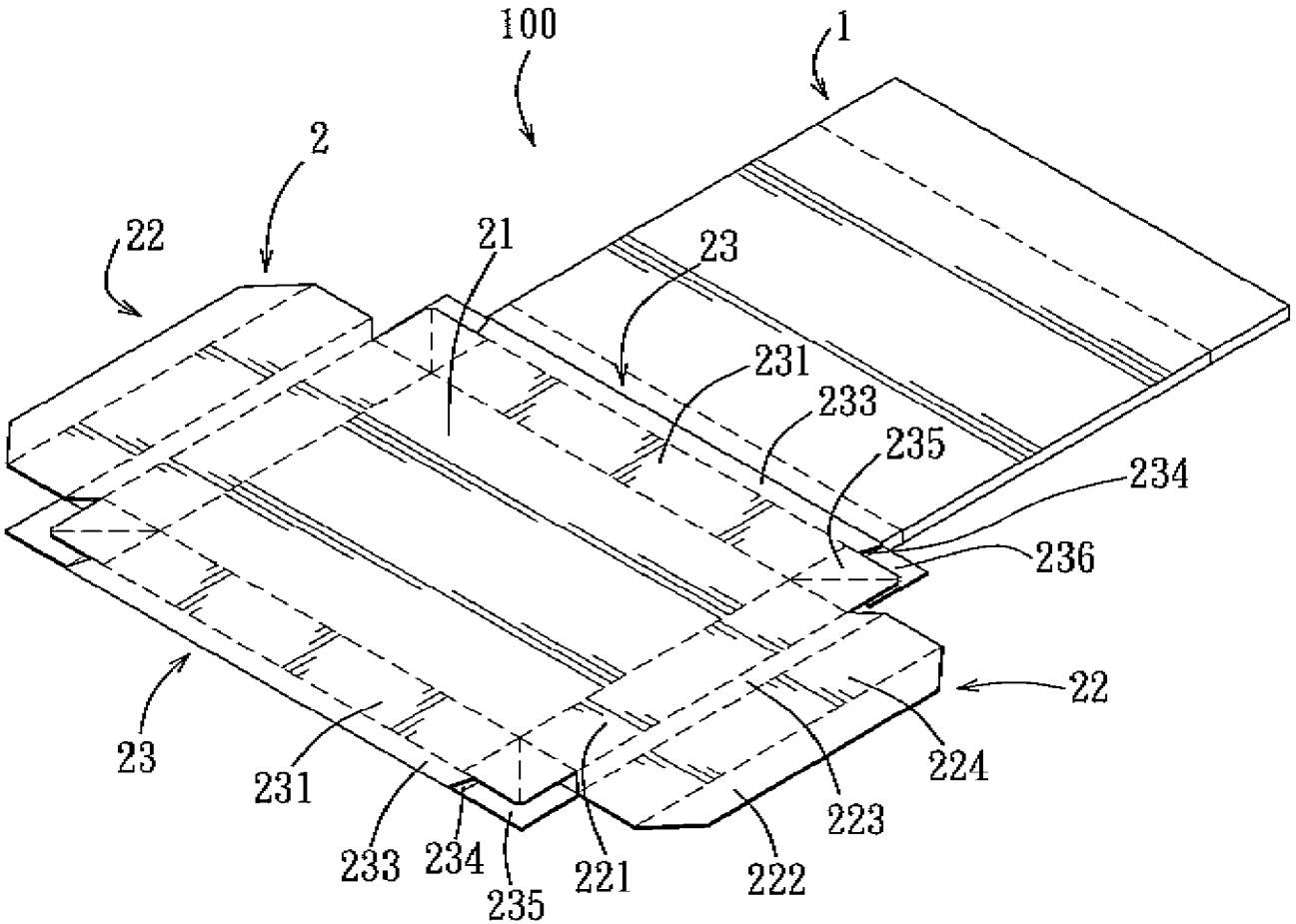
FIG. 1 is a perspective view of a foldable paper box according to a preferred embodiment of the invention in a flat configuration.

Referring to FIGS. 1 to 9, a foldable box 100 according to a preferred embodiment of the present invention includes an outer panel 1 and an inner panel 2 both of which are made from paper material. The outer panel 1 is a rectangular thick paperboard which has parallel first, second and third fold lines 31, 32, and 33 that are transverse to a longitudinal direction of the outer panel 1 and that divides the outer panel 1 into an outer base wall 11, a cover wall 12, a first outer sidewall 13 connected between the outer base wall 11 and the cover wall 12, and a second outer sidewall 14. The cover wall 12 is connected between the first and second outer sidewalls 13, 14. The second outer sidewall 14 is connected foldably to the cover wall 12 through the third fold lines 33. The outer base wall 11 has a first edge 111 opposite to the first outer sidewall 13, and two opposite second edges 112 connected respectively to two opposite ends of the first edge 111.

Figure 9:
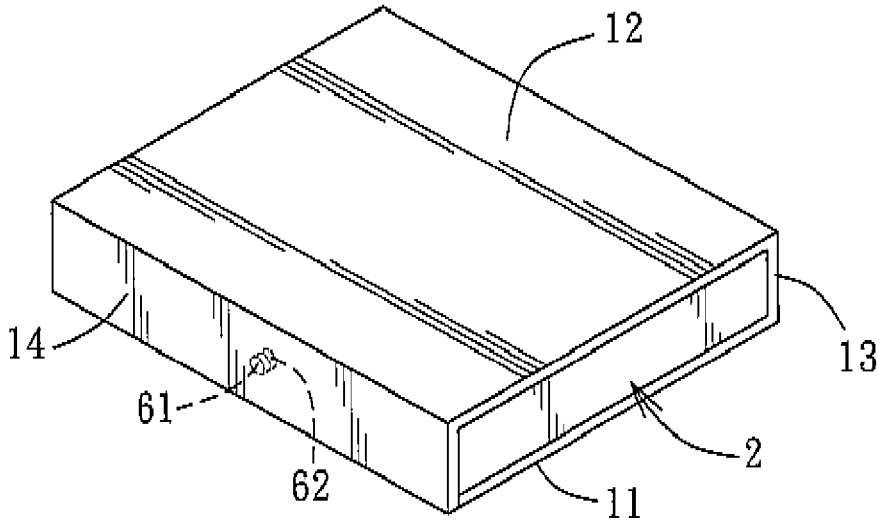
FIG. 9 is a perspective view of the foldable paper box in a closed position.

The outer panel 1 is foldable along the first, second and third fold lines 31, 32, 33 to place the cover wall 12 above the base wall 11 and to place the outer panel 1 in a closed position as shown in FIG. 9.

The inner panel 2 includes an inner base wall 21, a pair of first inner sidewalls 22 connected foldably and respectively to two opposite first sides of the inner base wall 21, and a pair of second inner sidewalls 23 connected foldably to two opposite second sides of the inner base wall 21, which interconnect the first sides of the inner base wall 21. The inner base wall 21 is rectangular and has an area smaller than that of the outer base wall 11 of the outer panel 1. The inner base wall 21 has an intermediate part 210 (FIGS. 6 & 7) secured to the top surface of the outer base wall 11 using an adhesive. The first inner sidewalls 22 are situated on the outer base wall 11 adjacent the second edges 112, respectively. One of the second inner sidewalls 23 is adjacent to the first edge 111 of the outer base wall 11. Because only the intermediate part 210 of the inner base wall 21 is adhered to the outer base wall 11 (FIGS. 6, 7), insert slots 101 are formed between the inner and outer base wall 21, 11 on two opposite sides of the intermediate part 210 and in proximity to the first inner sidewalls 22, respectively.

As best shown in FIGS. 2-6, each first inner sidewall 22 has a sidewall inner part 221 that is connected foldably to and extends uprightly from the inner base wall 21, first, second and third sidewall fold lines 41, 42, 43, a first sidewall top part 223 that is disposed between the first and second fold lines 41, 42 and that is connected foldably to the first inner sidewall part 221 through the first sidewall fold line 41 above the inner base wall 21, a first sidewall outer part 224 that is disposed between the second and third sidewall fold lines 42, 93 parallel to the first sidewall inner part 221 and that is connected foldably to the first sidewall top part 223 through the second sidewall fold line 42, and a first sidewall insert part 222 connected foldably to the first sidewall outer part 224 through the third sidewall fold line 43. The first sidewall insert parts 222 of the first inner sidewall 22 are inserted into the respective insert slots 101 (see FIGS. 6 and 7).

Each second inner sidewall 23 has a second sidewall inner part 231 connected foldably to and extending uprightly from the inner base wall 21, fourth, fifth, and sixth sidewall fold lines 51, 52, 53, a second sidewall top part 233 disposed between the fourth and fifth sidewall fold lines 51, 52 and connected foldably to the second sidewall, inner part 231 through the fourth sidewall fold line 51 above the inner base wall 21, a second sidewall outer part 234 that is disposed between the fifth and sixth sidewall fold lines 52, 53 in parallel to the second sidewall inner part 231 and that is connected foldably to the second sidewall top part 233 through the fifth sidewall fold line 52, a connection part 232 that is connected foldably to the sidewall outer part 234 through the sixth sidewall fold line 53 and that is inserted between the inner and outer panels 2, 1 and is secured to a top side of the outer base wall 11, and two tabs 236 connected foldably and respectively to and projecting from two opposite ends of the second sidewall outer part 234 in opposite directions along a line parallel to the fourth to sixth sidewall fold lines 51-53. The tabs 236 are folded from the respective second sidewall outer part 234 to extend between the first sidewall inner and outer parts 221, 224 of an adjacent one of the first inner sidewalls 22.

The inner panel 2 further has four corner parts 235 each of which is connected foldably to one of the first sidewall inner parts 221 and to one of the second sidewall inner parts 231 and has a diagonal fold line 2351. Each corner part 235 is folded along the diagonal fold line 2351 (FIG. 3) and then folded with respect to an adjacent one of the second sidewall inner part 231 to extend between the adjacent first sidewall inner and outer parts 221, 224.

Referring back to FIGS. 4 and 5, after the second inner sidewalls 23 are folded to extend uprightly from the inner base wall 21 as shown in FIGS. 4 and 5, the connection parts 232 (shown in FIG. 3) are extended to a bottom side of the inner base wall 21 and secured to a top side of the outer base wall 11. Therefore, the inner panel 2 is assembled on the outer panel 1 through adhesion of the intermediate part 210 of the inner base wall 21 and adhesion of the connection parts 232 of the second inner sidewalls 23 to the top side of the outer base wall 11. The assembly of the inner and outer panels 2, 1 constitutes the foldable paper box 100 that can be placed in an unfolded flat configuration (FIG. 1) wherein the second sidewall inner parts 231 and the second sidewall top parts 233 are laid on the respective second sidewall outer parts 234. The foldable paper box 100 can also be folded to form three dimensional configurations (FIGS. 4, 5 8) wherein the second inner sidewalls 22 extend uprightly from the inner base wall 21.

Figure 4:
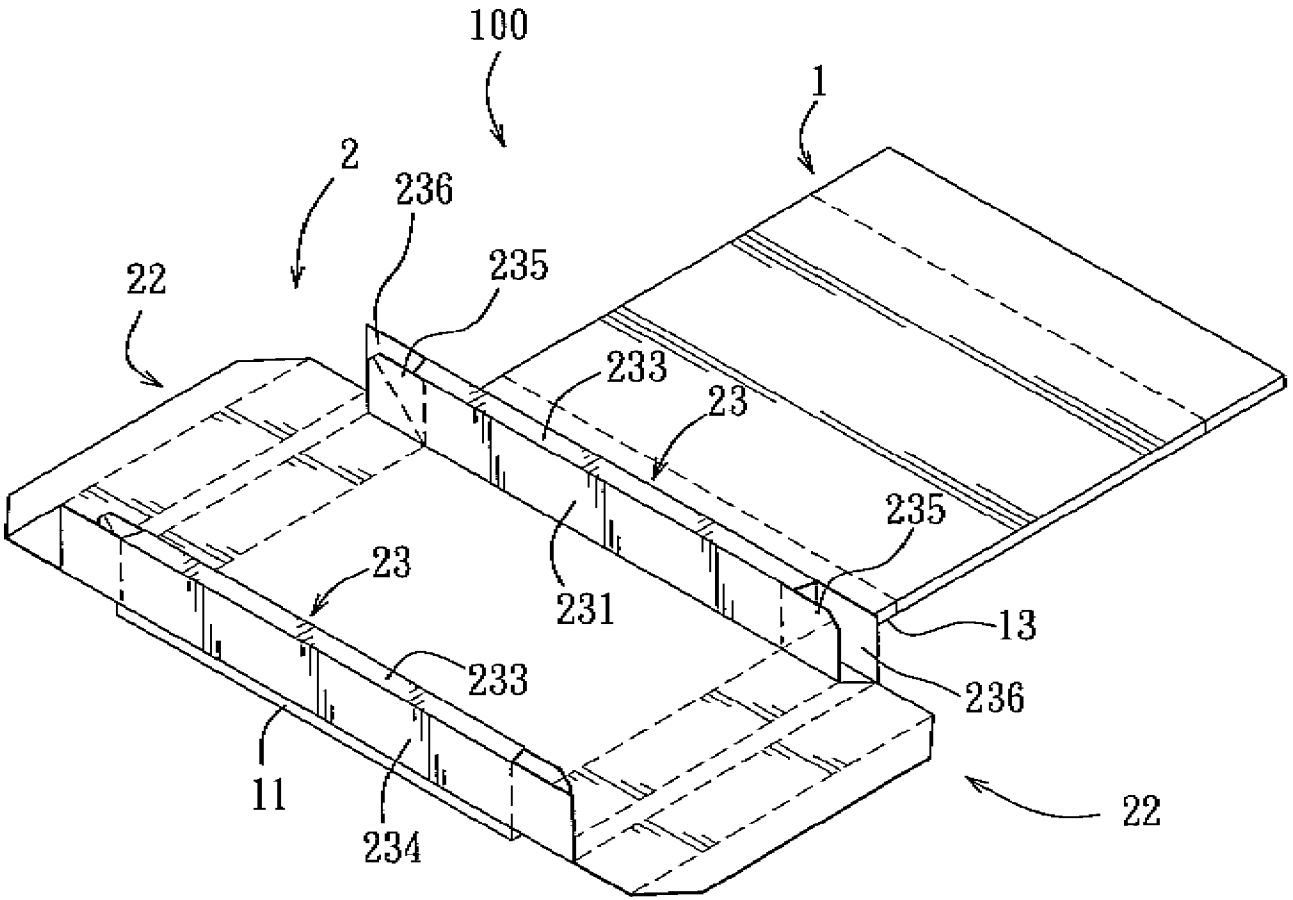
FIG. 4 is a perspective view of the foldable paper box in a three dimensional configuration.
Figure 5:
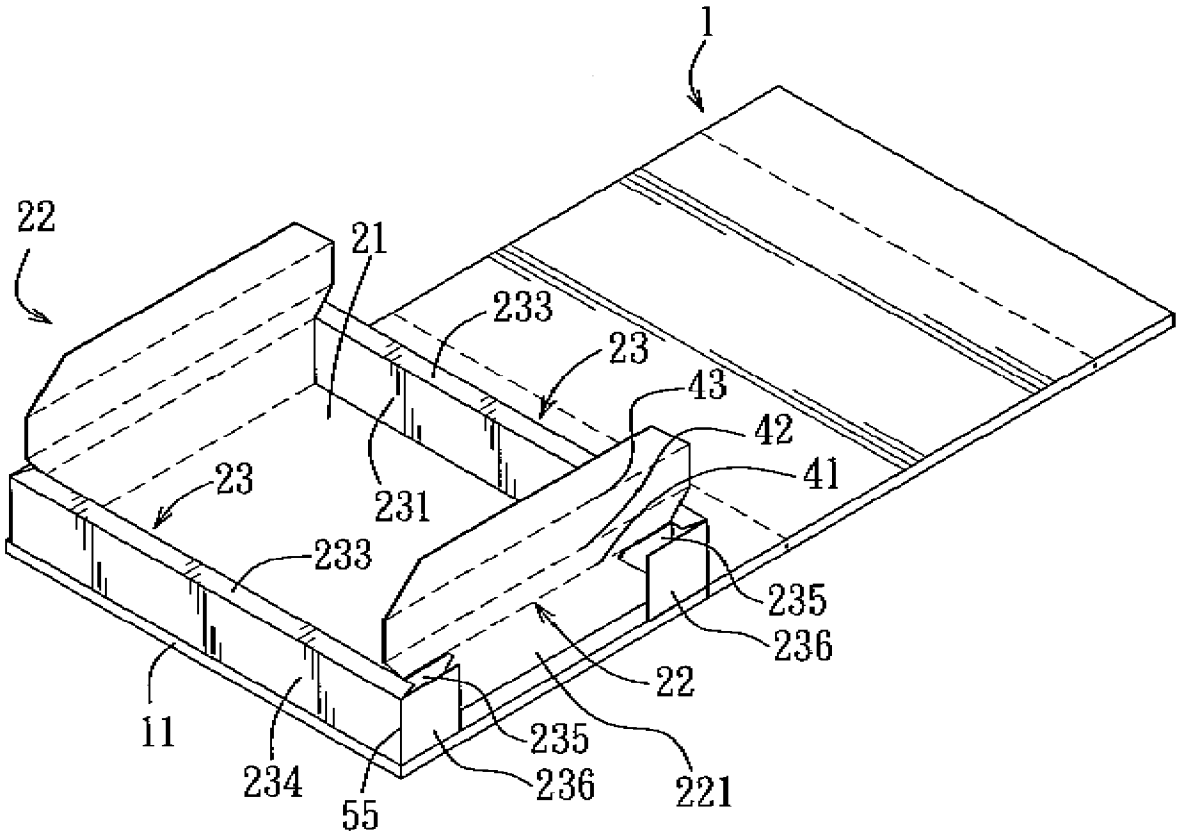
FIG. 5 is a perspective view of the foldable paper box in another three dimensional configuration.

Referring again to FIGS. 1 and 4, in use, the second inner sidewalls 23 are first moved from the position shown in FIG. 1 to the position shown in FIG. 4. In FIG. 4, the second sidewall inner and outer parts 231, 234 extend upright and the second sidewall top parts 233 face upward. In FIG. 5, the first inner sidewalls 22 are folded uprightly, and the corner parts 235 are folded to be triangular. Thereafter, the folded corner parts 235 and the tabs 236 are folded at right angles along respectively fold lines 54, 55 (FIG. 3) to extend to the first inner sidewalls 22.

Figure 2:
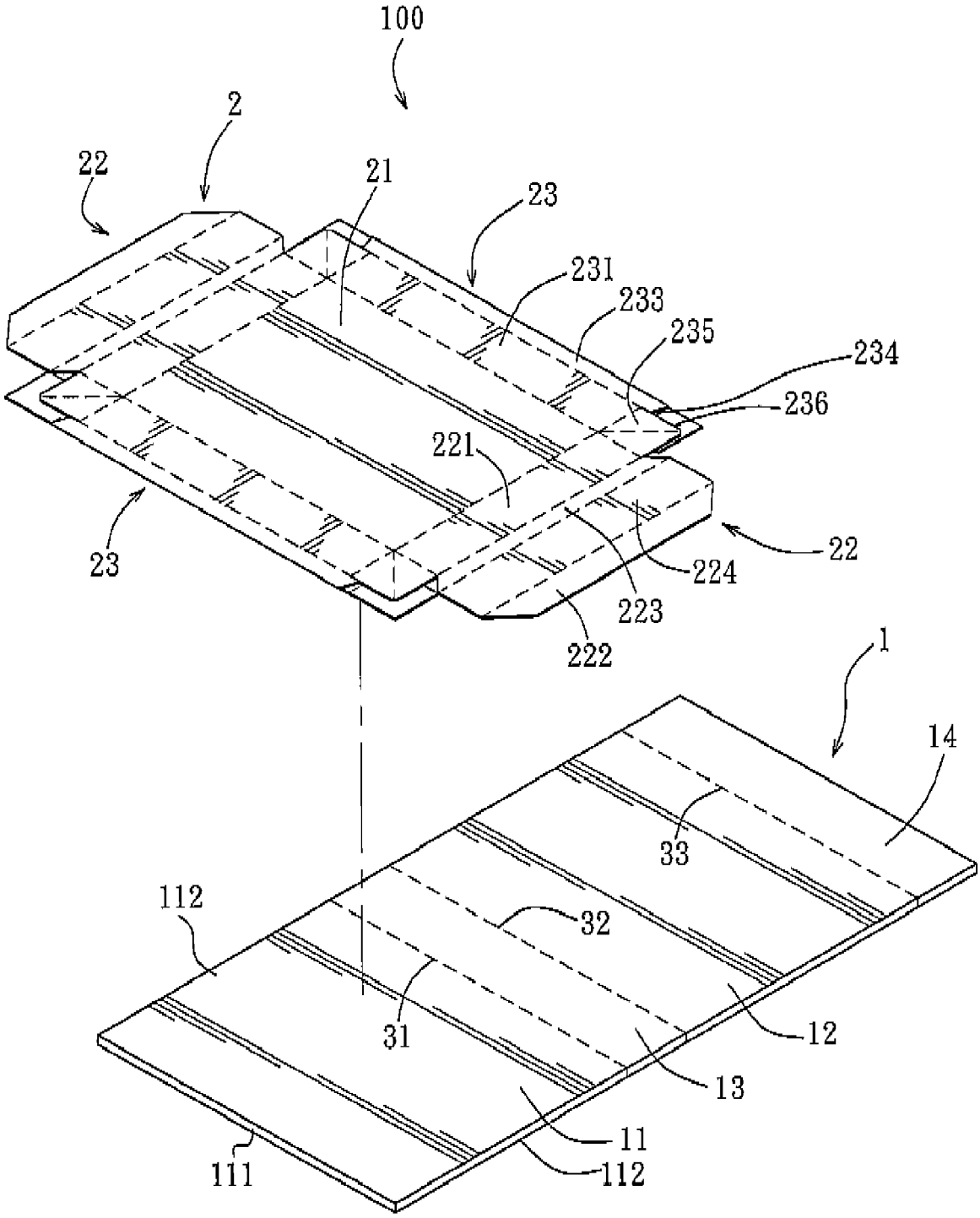
FIG. 2 is an exploded view of the foldable paper box.
Figure 3:
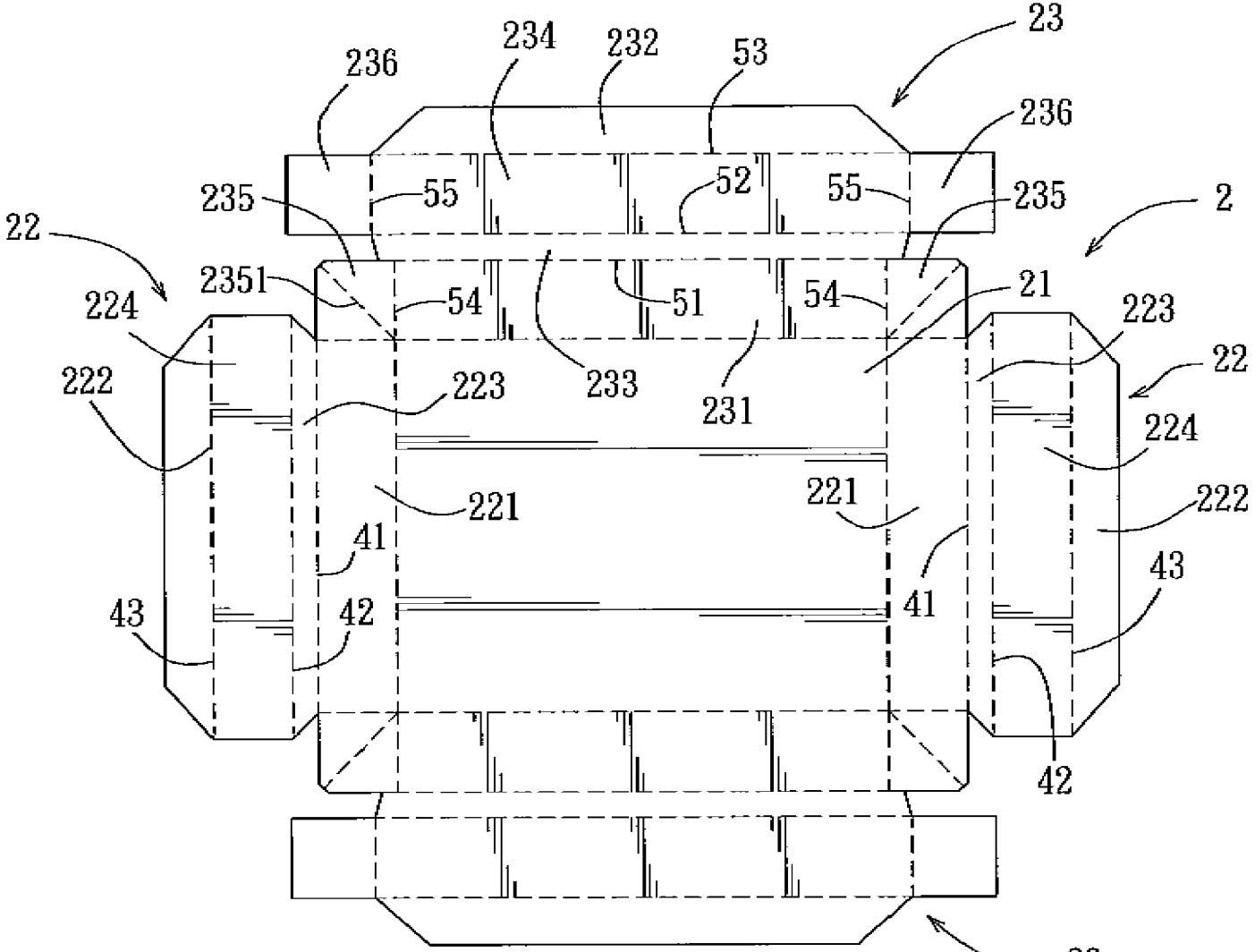
FIG. 3 is a plan view of an inner panel of the foldable paper box.
Figure 6:
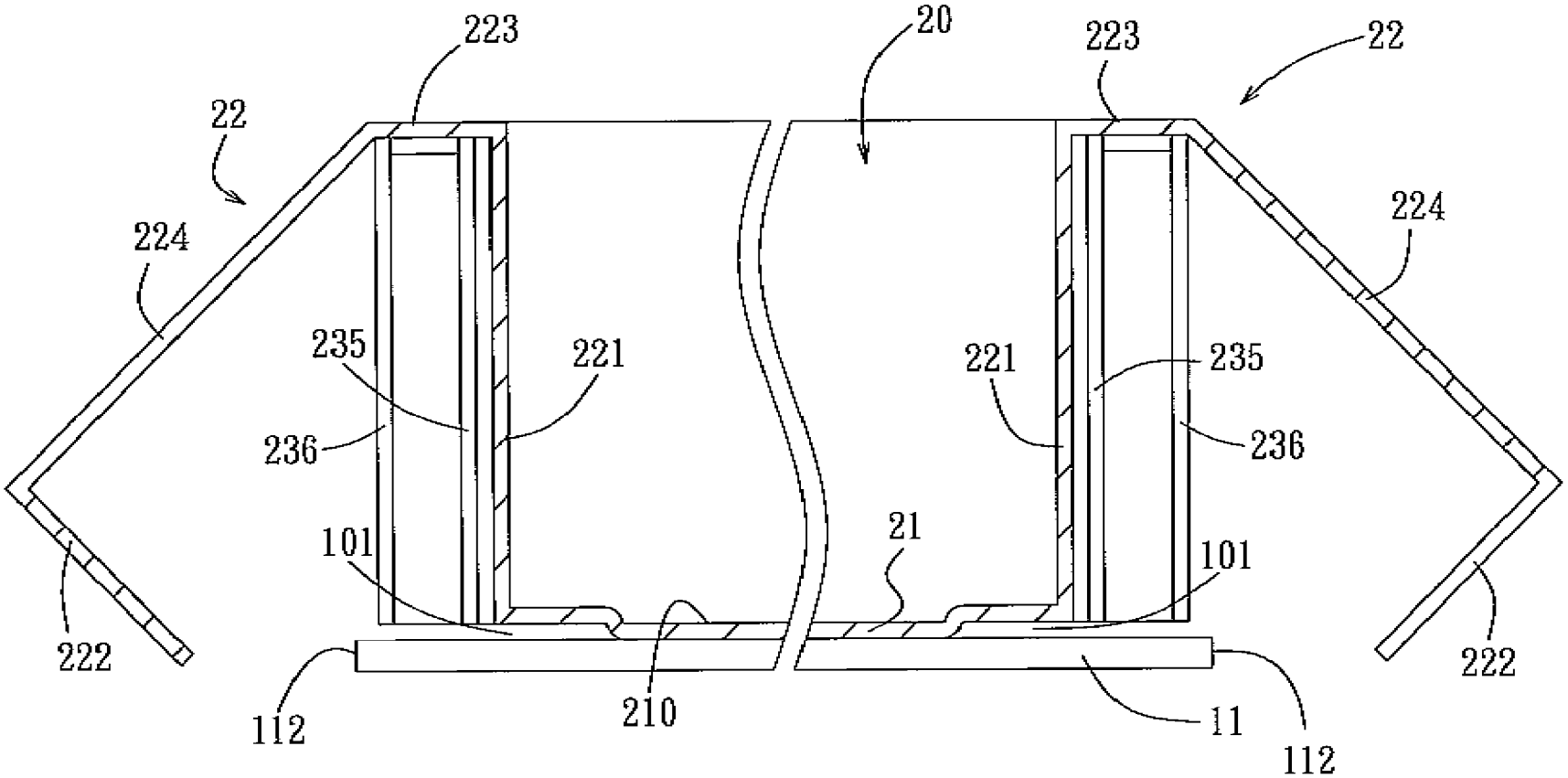
FIG. 6 is a sectional view of the foldable paper box.
Figure 7:
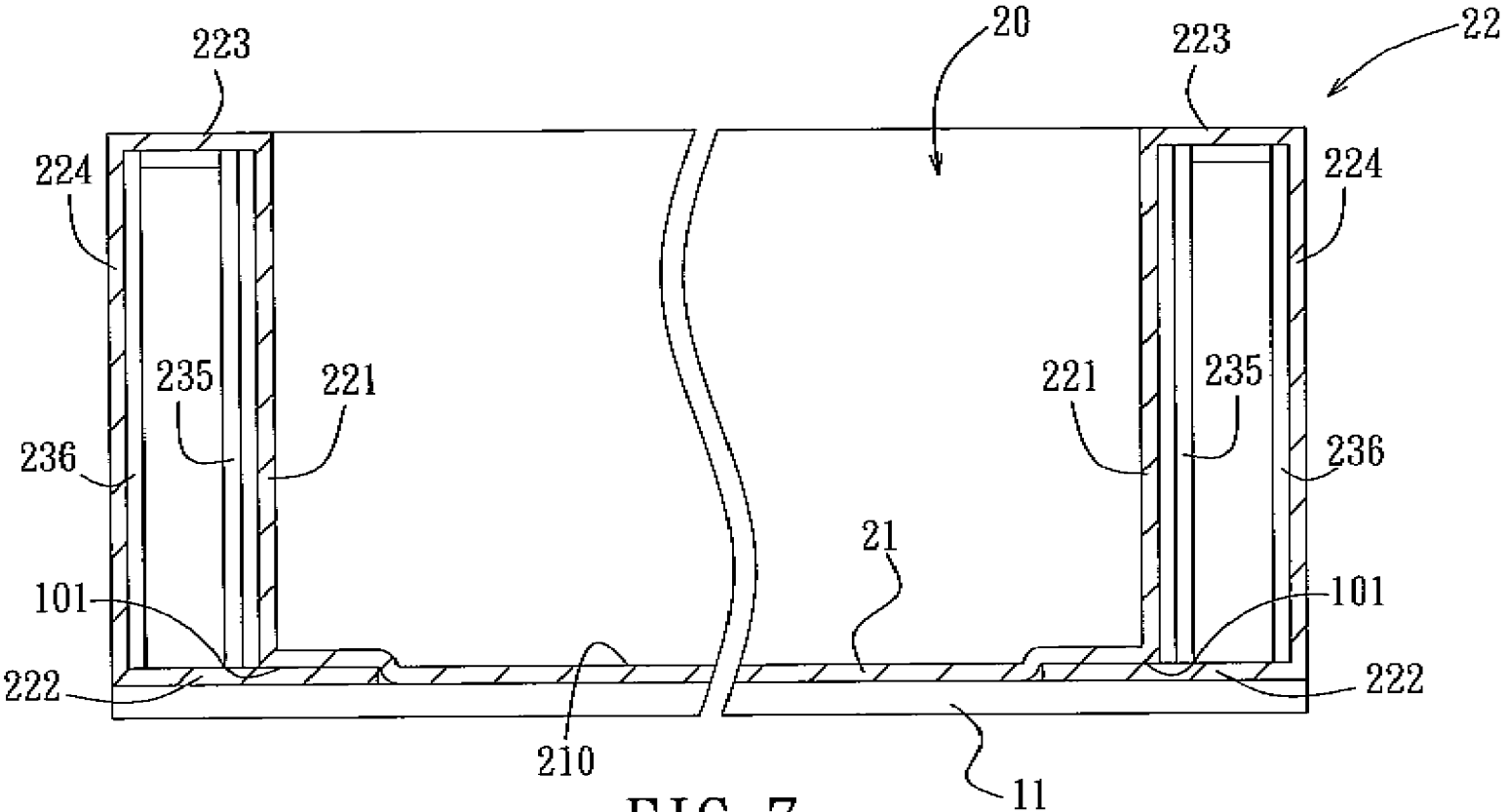
FIG. 7 is the same view as FIG. 6 but with the insert parts of the inner panel being inserted into respective insert slots.

Referring to FIGS. 6 and 7, the first inner sidewalls 22 are folded upward and outward along the first, second and third sidewall fold lines 41, 42, 43 (FIG. 3) so that the corner parts 235 and the tabs 236 are enclosed by the first sidewall inner, top and outer parts 221, 223, 224. The first sidewall insert parts 222 are inserted respectively into the insert slots 101. Referring to FIG. 2, a receiving space 20 is formed after the first and second inner sidewalls 22 and 23 are folded upward. The foldable paper box 100 is thus formed into a three dimensional configuration. As mentioned above, the foldable paper box 100 is placed in its folded three dimensional configuration after the first sidewall insert parts 222 are inserted into the insert slots 101. No fasteners are needed to hold the foldable paper box 100 in the three dimensional folded position.

Figure 8:
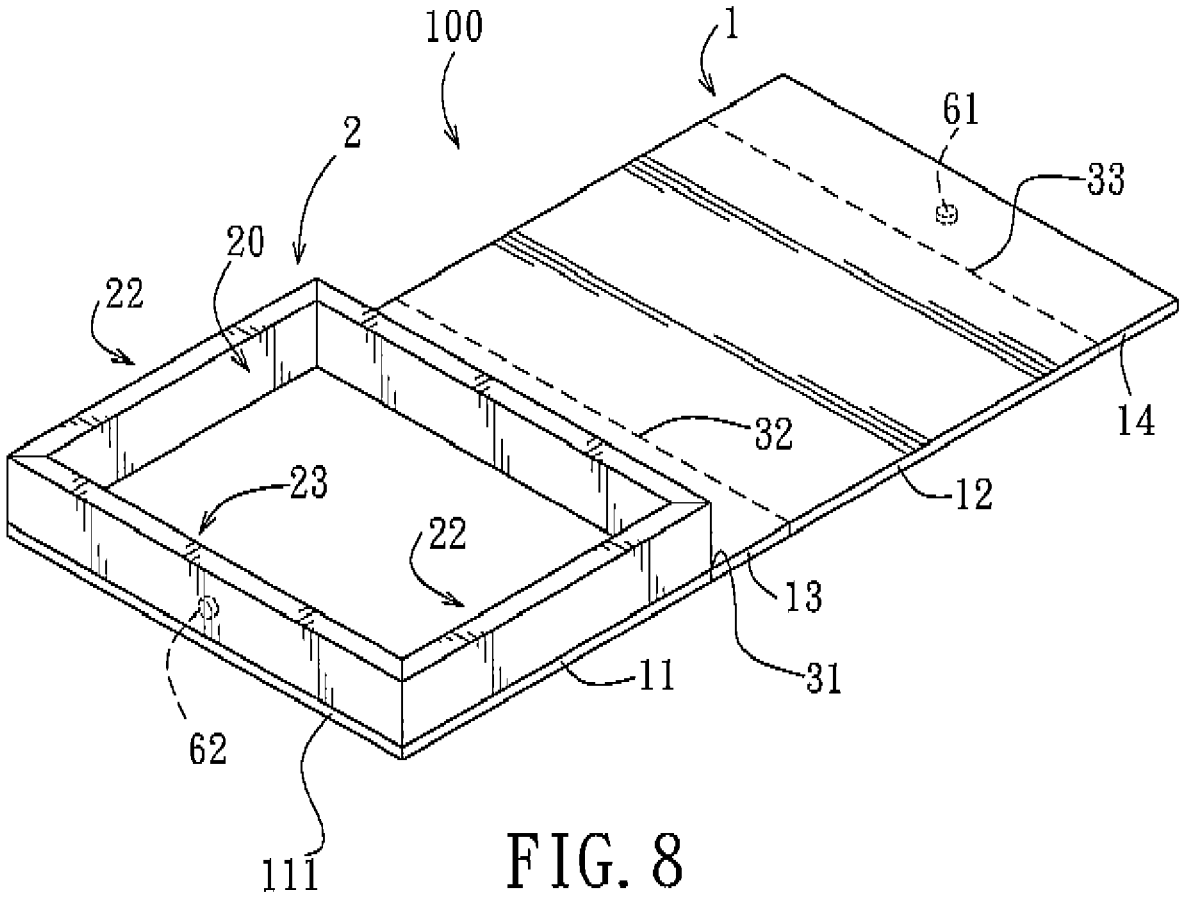
FIG. 8 is a perspective view of the foldable paper box in a completely folded configuration.

Referring to FIG. 9 in combination with FIG. 8, after the inner panel 2 is folded completely, the outer panel 1 may be folded along the fold lines 31, 32 and 33 to place the cover wall 12 above the inner panel 2, to close the receiving space 20 and to extend the second outer sidewall 14 over an outer surface of the second inner sidewall 23. In order to fasten the second outer sidewall 14 to the second inner sidewall 23, male and female fasteners 61, 62 are attached respectively to the second outer sidewall 14 and the second inner sidewall 23. Preferably, the male and female fasteners 61, 62 are magnetic fasteners.

While the present invention has been described in connection with what are considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A foldable paper box comprising:

a longitudinal outer panel having parallel first and second fold lines that extends transversely of a longitudinal direction of said outer panel and that divides said outer panel into an outer base wall, a cover wall, and a first outer sidewall between said outer base wall and said cover wall, said outer panel being folded along said first and second fold lines to place said cover wall above said outer base wall; and an inner panel having an inner base wall secured to said outer base wall, two opposite parallel first inner sidewalls connected foldably and respectively to two opposite first sides of said inner base wall, two opposite parallel second inner sidewalls connected foldably and respectively to two opposite second sides of said inner base wall, which are connected between said first sides of said inner base wall, said first and second inner sidewalls confining a receiving space on said inner base wall that extends uprightly from said inner base wall, said receiving space being covered by said cover wall when said outer panel is folded over said inner base wall;

said outer and inner base walls confining therebetween two insert slots respectively adjacent to said first inner sidewalls, said first inner sidewalls being folded upwardly and outwardly from said inner base wall and inserted partially, removably and respectively into said insert slots, said second inner sidewalls being folded outwardly from said inner base wall, inserted partially between said inner and outer base walls, and secured non-removably to said outer base wall.

2. The foldable paper box of claim 1, wherein said inner base wall has an intermediate part secured to said outer base wall, said insert slots being formed between said inner and outer base walls on two opposite sides of said intermediate part.

3. The foldable paper box of claim 1, wherein each of said first inner sidewall has a sidewall inner part connected foldably to and extending uprightly from said inner base wall, first, second and third sidewall fold lines, a first sidewall top part disposed between said first and second sidewall fold lines and connected foldably to said first inner sidewall part through said first sidewall fold line above said inner base wall, a first sidewall outer part that is disposed between said second and third sidewall fold lines in parallel to said first sidewall inner part and that is connected foldably to said first sidewall top part through said second sidewall fold line, and a first sidewall insert part connected foldably to said first sidewall outer part through said third sidewall fold line, said first sidewall insert part being inserted removably into one of said insert slots.

4. The foldable paper box of claim 3, wherein each of said second inner sidewalls has a second sidewall inner part connected foldably to and extending uprightly from said inner base wall, fourth, fifth, and sixth sidewall fold lines, a second sidewall top part disposed between said fourth and fifth sidewall fold lines and connected foldably to said second sidewall inner part through said fourth sidewall fold line above said inner base wall, a second sidewall outer part that is disposed between said fifth and sixth sidewall fold lines in parallel to said second sidewall inner part and that is connected foldably to said second sidewall top part through said fifth sidewall fold line, a connection part that is connected foldably to said sidewall outer part through said sixth sidewall fold line and that is inserted between said outer and inner base walls and secured to a top side of said outer base wall.

5. The foldable paper box of claim 4, wherein said inner panel further has four corner parts each of which is connected foldably to said first sidewall inner part of one of said first inner sidewalls and to said second sidewall inner part of one of said second inner sidewalls and each of which has a diagonal fold line, each of said corner parts being folded along said diagonal fold line and further folded to extend between said first sidewall inner and outer parts of an adjacent one of said first inner sidewalls.

6. The foldable paper box of claim 5, wherein said second inner sidewall further has two tabs connected foldably and respectively to and projecting from two opposite ends of said second sidewall outer part in opposite directions along a line parallel to said fourth to sixth fold lines, said tabs being folded from said second sidewall outer part to extend between said first sidewall inner and outer parts of an adjacent one of said first inner sidewalls.

7. The foldable paper box of claim 6, wherein said outer panel further has a third fold line parallel to said first and second fold lines of said outer panel, and a second outer sidewall connected foldably to said cover wall through said third fold line of said outer panel, said second inner sidewalls being parallel to said first and second fold lines of said outer panel, said first and second outer sidewalls respectively covering said second inner sidewalls when said cover wall is placed over said outer and inner base walls.

8. The foldable paper box of claim 7, further comprising male and female fasteners respectively attached to said second outer sidewall and one of said second inner sidewalls.

* * * * *